United States Patent [19]

De Meio et al.

[11] Patent Number: 4,664,558

[45] Date of Patent: May 12, 1987

[54] REVERSIBLE MECHANICAL COUPLING FOR TENSIONAL ANCHORAGES

[75] Inventors: Apollonio De Meio, Venice; Roberto Brandi, Padua, both of Italy

[73] Assignee: AGIP S.p.A., Milan, Italy

[21] Appl. No.: 749,648

[22] Filed: Jun. 28, 1985

[30] Foreign Application Priority Data

Jul. 9, 1984 [IT] Italy ..... 84116 A/84

[51] Int. Cl.[4] ..... E02B 17/00

[52] U.S. Cl. ..... 405/224; 285/18; 405/195

[58] Field of Search ..... 405/195, 224; 285/18, 285/319; 166/338, 339, 340, 351, 359

[56] References Cited

U.S. PATENT DOCUMENTS

| | | | |
|---|---|---|---|
| 3,325,190 | 6/1967 | Eckert et al. | 166/340 X |
| 3,675,713 | 7/1972 | Watkins | 166/340 |
| 4,372,707 | 2/1983 | Ostgaard | 405/224 |
| 4,432,670 | 2/1984 | Lawson | 405/224 |
| 4,459,933 | 7/1984 | Burchett | 405/224 X |
| 4,491,439 | 1/1985 | Watkins | 405/224 |

*Primary Examiner*—David H. Corbin

*Attorney, Agent, or Firm*—Morgan & Finnegan

[57] ABSTRACT

A reversible mechanical coupling for tensional anchorages includes a cylindrical body having a widened portion of conical shape capable of causing a set of clamping levers to be radially expanded by pivoting around a lower linking ring controlled to move coaxially with the cylindrical body by a first set of oleodynamic cylinders supported by the cylindrical body. The clamping levers are kept in contact with the body by springs, and are in mechanical interference, in their expanded position, with a conical surface provided in the seat for the coupling. A set of vertical guides is for provided on the upper portion of the cylindrical body for guiding a set of wedges pivoting around an upper linking ring controlled to move coaxially with the cylindrical body by a second set of oleodynamic cylinders supported by the body.

10 Claims, 6 Drawing Figures

Fig.5
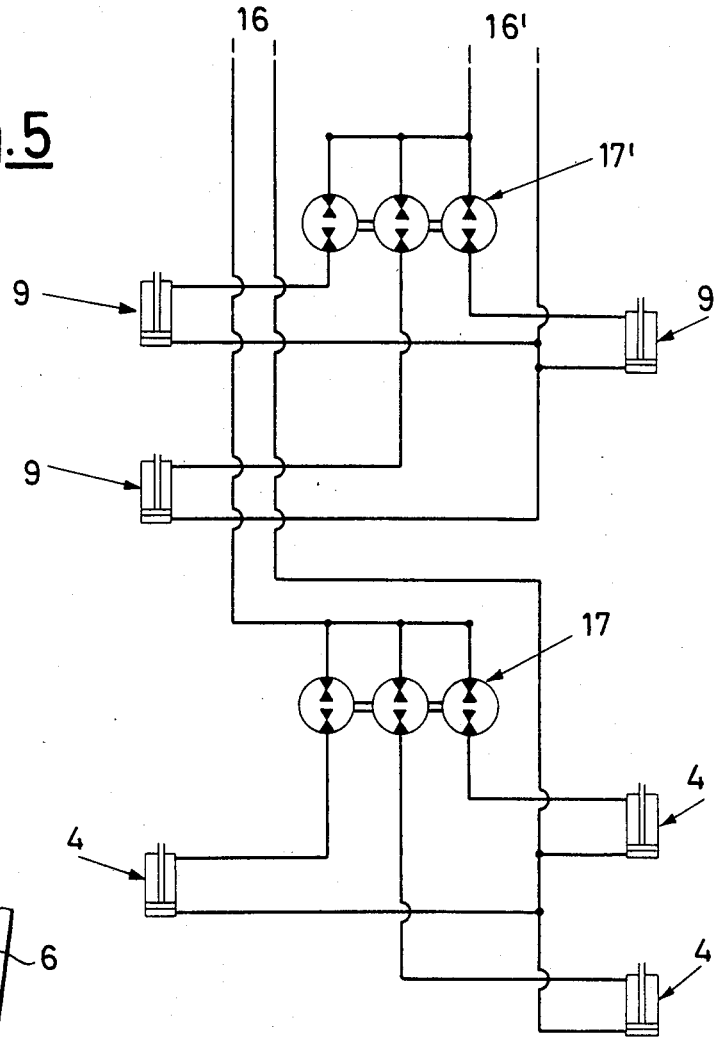
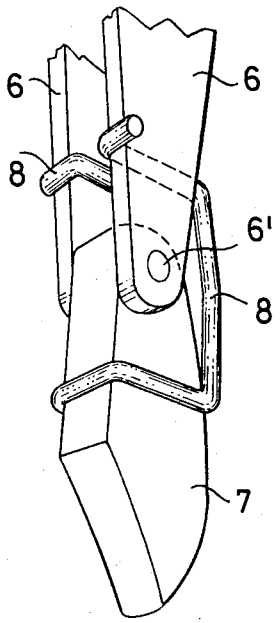
Fig.6

REVERSIBLE MECHANICAL COUPLING FOR TENSIONAL ANCHORAGES

TECHNICAL FIELD

The present invention relates to a novel reversible mechanical coupling for the structural linking of the tubular anchorages of marine platforms with tensional anchorages, known as TLP, i.e., "Tension Leg Platforms", to the foundation bases positioned on sea bottom.

BACKGROUND AND OBJECTS OF THE INVENTION

It is known that certain types of marine platforms are anchored to the sea bottom by means of a set of tensional tubular anchorages which are structurally linked to the foundation bases positioned on the sea bottom by means of reversible mechanical couplings which clamp themselves inside suitable seats provided in the foundation bases.

The several types of reversible mechanical couplings known from the present state of the art for the purpose of the above linking to the sea bottom of tensional-anchorage marine platforms are not capable of discharging the flexural stresses the tubular anchorages undergo. Thus, in order to compensate for the flexural moment it is necessary to interpose between the anchorage and the coupling a ball joint, with all the drawbacks inherent in the use of such a device at great depths.

The purpose of the present invention is precisely to obviate this drawback and provide a coupling which allows the flexural moment stresses to be discharged without the need of using additional devices.

SUMMARY OF THE INVENTION

This purpose is substantially achieved by the fact that the coupling is accomplished by a tubular body onto which two types of clamping devices are mounted, at a suitable distance: clamping levers and wedges.

The clamping levers, hydraulically actuated, generate a mechanical interference between the lowermost end of the body of the coupling and the corresponding conical zone of the seat.

Thanks to this interference, accomplished on a conical surface, both vertical and horizontal forces can be discharged.

The wedges, which are also hydraulically actuated, suppress the clearance between the upper part of the body of the coupling and the corresponding seat zone.

Through the wedges horizontal forces can be discharged. Due to the actions of the clamping levers and to the wedges, the coupling is capable of discharging not only the tensile stresses and the shear stresses, but also the flexural moments. In fact, the horizontal component of the reaction force exerted by the conical surface of the seat on the clamping levers, together with the opposing force exerted by the seat on the wedges, result in forces which counteract the flexural moment acting on the tubular anchorage and, hence, on the coupling secured to the end of the anchorage.

By minor changes, which do not alter the spirit of the invention, the coupling could also be suitable to the transmission of the twisting moment by means of suitable vertical extensions provided on the outer surfaces of wedges, to be inserted into corresponding vertical slots provided in the seat.

In particular, the coupling of the present invention provides a coupling which:

discharges high tensile, flexural moment, shear and possibly twisting moment stresses, by virtue of the tubular geometrical shape, without weakening holes, and hence is very efficient from the structural viewpoint, of the of the coupling, and by virtue of the stresses on the clamping devices, clamping lever and wedges, which are essentially of the compression type;

accomplishes a clearance-free clamping, also with broad dimensional constructive tolerances;

carries out the clamping of the coupling to the seat, and the release of it therefrom, by means of particularly simple operations;

carries out the clamping of the coupling to the seat with broad tolerances in initial alignment and centering;

obtains an accurate alignment and centering of the coupling, relatively to the seat, after the clamping has occurred, in that the system is self-centering due to the effect of the conicalness of the seat;

maintains the coupling after possible breaks of the oleodynamic circuit, by virtue of the effect of the low-value conicalness of the wedges, lower than the minimum friction angle, and of the self-clamping effect of the coupling traction on the clamping levers;

maintains the link also after possible dimensional changes (corrosion, impacts) of the coupling or of its seat;

provides a high degree of protection to the components of oleodynamic circuits;

permits the release of the coupling using ancillary equipment in case of malfunctioning of the actuating oleodynamic circuit.

Summarizing, the reversible mechanical coupling, to be clamped within a suitable anchorage seating provided in a foundation base for the purpose of anchoring to said base one of the tensional tubular anchorages of a tensional-anchorage marine platforms, is characterized according to the present invention in that it is constituted by a substantially cylindrical body ending in its lower portion in an inverted conical widened portion suitable to cause a set of clamping levers to radially expand. The clamping levers are pivoted in their upper portion around a lower linking ring which is coaxial with the cylindrical body and is controlled for axial movement by a first set of oleodynamic cylinders supported by the cylindrical body. The clamping levers are maintained in contact with the cylindrical body by springs and are in mechanical interference, in their expanded position, with a conical surface provided in the seat, the cylindrical body is provided in its upper portion with vertical guides for a set of wedges suitable to cooperate with the cylindrical surface of the seat the wedges being pivoted in their upper portion around an upper linking ring coaxial with the cylindrical body and controlled for axial movement by a second set of oleodynamic cylinders supported by the cylindrical body. Means are also provided for identically feeding the oleodynamic cylinders of each set.

According to another feature of the present invention, the clamping levers are pivoted around the lower linking ring by means of pivots having a small construction clearance, so that the pivots are not under stress when the coupling is in its clamping position, wherein the clamping levers are pressed against the conical surface of the seat.

Another feature of the invention is given by the fact that the wedges have a convergence angle lower than the minimum friction angle, which prevents their release when they are engaged and, also in case of loss of pressure inside the oleodynamic cylinders.

BRIEF DESCRIPTION OF THE DRAWINGS

Further features and preferred embodiments of the present invention shall become known from the following detailed description, wherein the invention is better clarified with reference to the attached drawings illustrating a preferred embodiment of the invention, given to exemplify and not by way of limitation since it shall always be possible to introduce technical or constructive changes without departing from the spirit of the invention, in which:

FIG. 5 represents the circuit diagram of the actuating oleodynamic circuit;

FIG. 6 represents an enlarged partial perspective view of a detail of the coupling according to the invention.

DETAILED DESCRIPTION OF THE PREFERRED EMBODIMENTS

Figure 1:
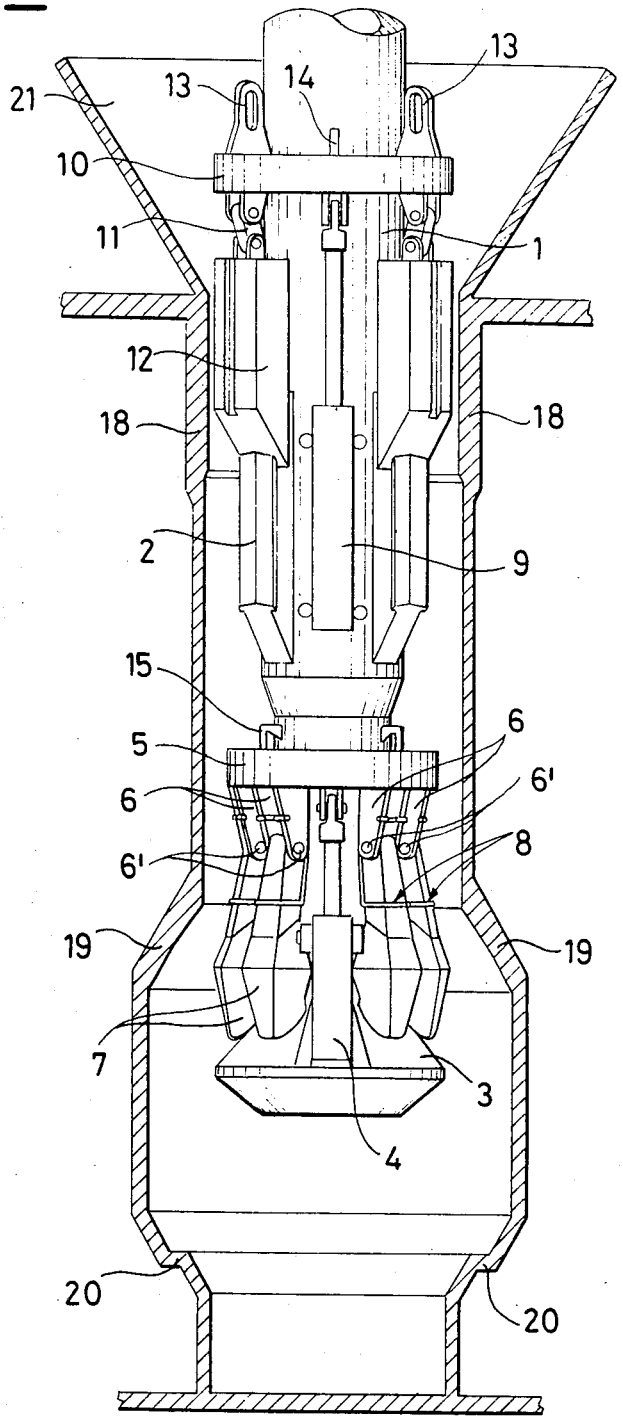
FIG. 1 represents a partly cutaway front view of the coupling according to the invention, already inserted within its related seat, but not yet clamped.
Figure 2:
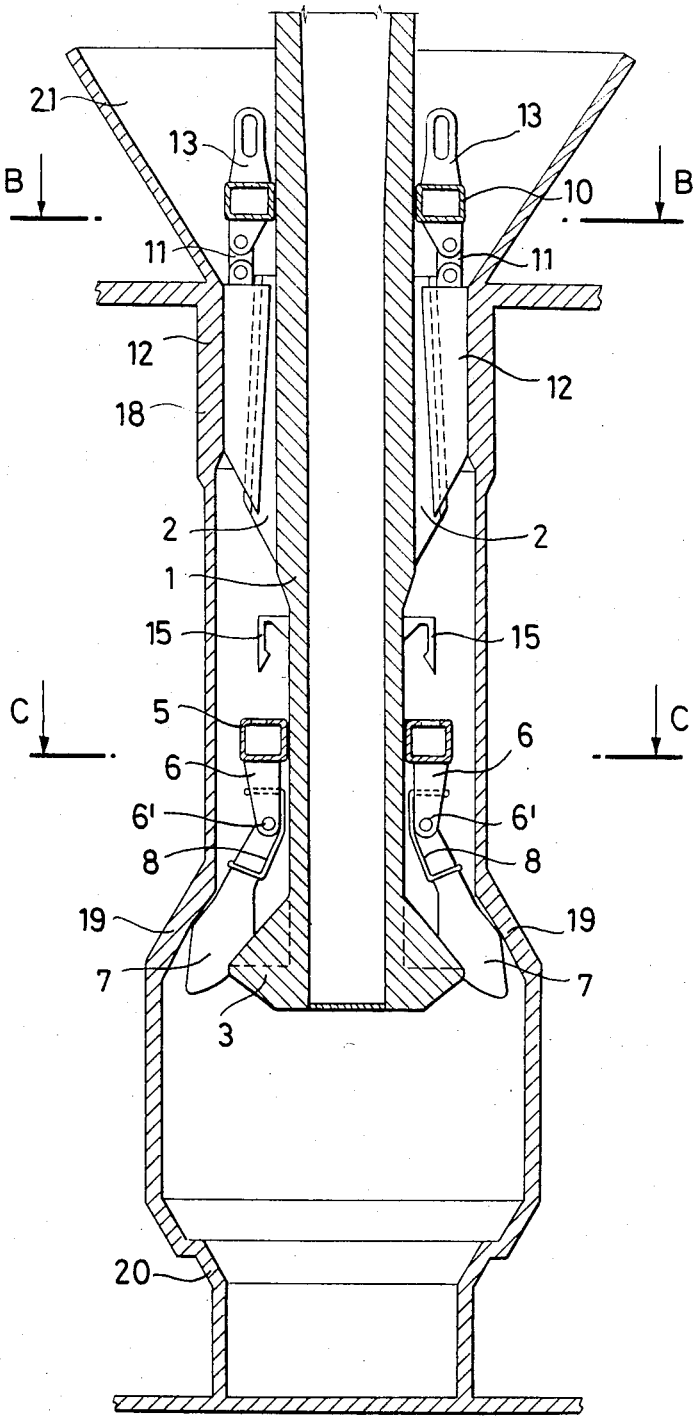
FIG. 2 represents a vertical section view of the coupling clamped in its seat according to the invention, taken along line A—A of FIG. 3.
Figure 3:
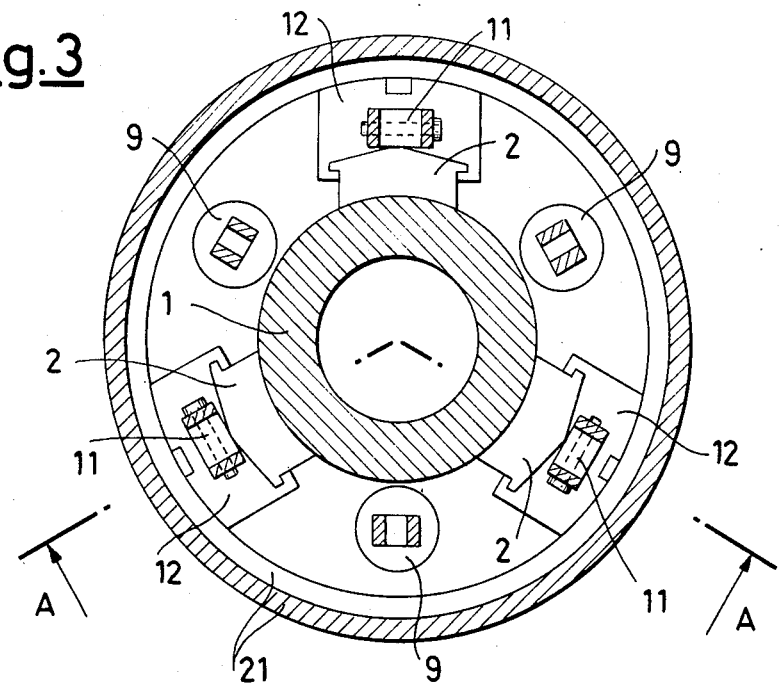
FIG. 3 represents an enlarged plan section view of the coupling taken along line B—B of FIG. 2.

Referring to the figures, the coupling is constituted by a tubular body 1 provided in its upper zone with guides 2 for the wedges 12, and whoe lower end is provided with a widened portion with reverse conicalness 3.

Near the lower end of the cylindrical body of the coupling, and external to it, the bodies of three oleodynamic cylinders 4 are fixed. The pistons of this first set of oleodynamic cylinders are hinged to a lower linking ring 5.

Figure 4:
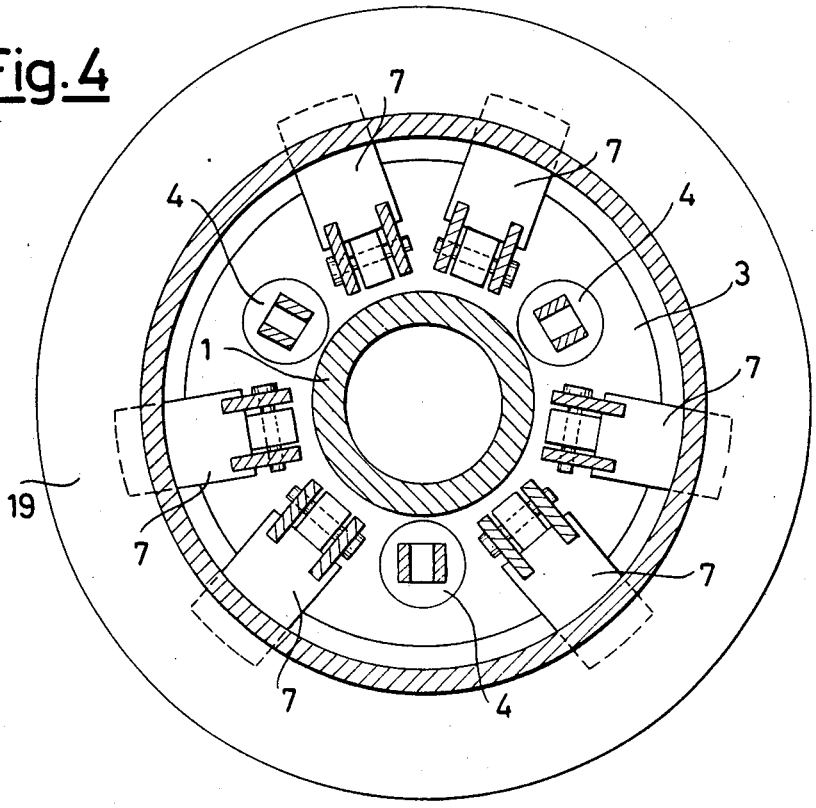
FIG. 4 represents an enlarged plan section view of the coupling taken along line C—C of FIG. 2.

On the lower linking ring 5 three pairs of clamping levers 7 are mounted through the brackets 6 and the pivots 6' (see specifically FIG. 4).

The clamping levers 7 are kept in contact with the body of the connector or coupling by the action of the springs 8 acting between the levers and the brackets 6 of the linking ring 5 (see specifically FIG. 6).

The pivots 6' linking the clamping levers 7 to the brackets 6 of the ring 5 have a slight construction clearance so that when the coupling is in its clamped position the pivots are not under stress since the forces involved are all discharged by the clamping levers 7 onto the conical body 19 of the seat.

On the upper portion of the body of the coupling and external to it, the bodies of three oleodynamic cylinders 9 are fixed. The pistons of this second set of cylinders are hinged onto the upper ring 10.

Small connecting rods 11 and three wedges 12 positioned at 120° are linked to upper ring 10. Wedges 12 slide along the apposite guides 2 of the coupling body.

The wedges 12 have a convergence angle smaller than the minimum friction angle, which prevents them from releasing when engaged in practice or in case of loss of pressure in oleodynamic cylinders 9.

On the upper linking ring 10 lifting eyes 13 are fastened, to be used in case the manual release of the coupling according to the emergency procedure becomes necessary.

Both the upper linking ring 10 and the lower linking ring 5 in their position of upper limit of stroke engage respectively first and second sets of hooks 14 and 15 (see FIG. 1).

The action of hooks 14 and 15 is sufficient to hold the weight of the linking rings and of the devices hanging from them, in the absence of pressure in the oleodynamic circuit.

Inside the body of the coupling, possibly in an oil bath under room pressure, a portion of the actuating oleodynamic circuit is housed.

With reference to FIG. 5, each one of the oleodynamic circuits for the actuation of the wedges and of the clamping levers is respectively constituted by:

delivery and return line 16 and 16';

flow partitioner 17 and 17';

oleodynamic cylinders 4 and 9.

The oleodynamic lines connecting the cylinders to the flow partitioners pass through the body of the connector or coupling through bores suitably provided in the body or the connector, or on the bottom wall thereof.

Each flow partitioner 17 or 17', essentially constituted by three oleodynamic motors (gear motors or axial-piston motors) assembled on the same shaft, guarantees an equal delivery, and hence a same stroke, to the three oleodynamic cylinders 9 or 4 connected thereto.

The delivery and return lines 16 and 16' are led inside the anchorage tube, or by another way, respectively to the feeding pump and to the outlet.

The seat for the coupling is composed of an upper part of nearly cylindrical shape wherein the wedge engages zone 18 and a downwardly and outwardly projecting lower portion 19 of conical shape, intended for the centering and engagement of the clamping levers.

The clamping of the coupling inside its seat is obtained as follows.

The coupling, with the oleodynamic cylinders in their extended position shown in FIG. 1, is inserted inside its seat. The centering cone 21, fastened at the mouth of the seat, facilitates this operation. The clearance existing in this step between the coupling and the seat allows the insertion to be carried out also in the presence of eccentricity and misalignments.

When the coupling has reached its position shown in FIG. 1, the lower oleodynamic cylinders 4 are contracted. This causes the lowering of the lower linking ring 5 and, as a consequence, the rotation outwards of the clamping levers 7 which come to lean on the widened portion 3. The coupling is then pulled upwards until the clamping levers 7 come in contact with the conical portion 19 of the seat. The movement upwards of the coupling causes the precise centering of the lower end of the coupling, due to the effect of the conicalness of the seat on levers 7.

The contraction of the upper oleodynamic cylinders 9 causes the lowering of the upper linking ring 10 and as a consequence of the wedges 12, which shall thus be pushed against the wedge engaging zone 18 of the seat.

This causes the precise alignment of the coupling to the seat, and their mutual clamping.

The release of the coupling from the seat is obtained by carrying out in the reverse fashion the same procedure as described for the clamping.

Should any malfunctioning of the oleodynamic circuit not allow the release of the coupling to be carried out in the normal way, the emergency release procedure shall be carried out as described below.

By means of an auxiliary equipment (e.g., ropes from the platform, or a jack system installed on foundation bases) linked to lifting eyes 13 the upper ring 10 is lifted until upper ring 10 engages hooks 14.

The clearance which is consequently generated between the wedges 12 and the upper portion of the seat 18, allows the coupling to be lowered.

Downward movement of the cylindrical body causes clamping levers 7 to lean against the lower end 20 of the seat, and further movement downwards causes the clamping of the lower ring 5 onto hooks 15.

The action of the springs 8, or eventually of the conical zone 19 of the seat during upward movement causes rotation of the clamping levers 7 toward the cylindrical body so as to allow extraction of the coupling from the seat.

What is claimed is:

1. A reversible mechanical coupling for linking tension leg platforms to foundation bases on the sea bottom comprising:

(i) an anchorage seating attached to a foundation base on the sea bottom, said anchorage seating having a substantially cylindrical upper portion and a downwardly and outwardly projecting conical seating surface at the lower portion thereof;

(ii) a substantially cylindrical body adapted to be inserted into said anchorage seating, said substantially cylindrical body having an inverted conical section at the lower portion thereof and vertical guides at the upper portion thereof;

(iii) a lower linking ring coaxially and slidably mounted to said cylindrical body above said inverted conical section;

(iv) a plurality of clamping levers hingedly mounted at the upper portion thereof to said lower linking ring;

(v) first oleodynamic cylinder means attached to said lower linking ring and to said cylindrical body for controlling axial movement of said lower linking ring relative to said cylindrical body, said first oleodynamic cylinder means being adapted to urge said lower linking ring downwardly toward said inverted conical section so that said clamping levers hingedly attached to said lower linking ring are forced by said inverted conical section to expand outwardly and engage said conical seating surface of said anchorage seating when said cylindrical body is disposed within said anchorage seating;

(vi) an upper linking ring coaxially and slidably mounted to said cylindrical body above said lower linking ring and said vertical guides;

(vii) a plurality of wedges pivotally mounted at the upper portion thereof to said upper linking ring, said wedges engaging said vertical guides; and (viii) second oleodynamic cylinder means attached to said cylindrical body and to said upper linking ring for controlling axial movement of said upper linking ring relative to said cylindrical body, said second oleodynamic cylinder means being adapted to urge said upper linking ring downwardly to force said wedges downward relative to said vertical guides and cylindrical body so as to frictionally engage a wedge engaging zone of said cylindrical portion of said anchorage seating;

whereby engagement of said clamping levers with said conical seating surface and engagement of said wedges with said wedge engaging zone of said cylindrical portion of said anchorage seating secures said cylindrical body to said anchorage seating.

2. The reversible mechanical coupling according to claim 1 wherein said clamping levers are pivotally mounted to said lower linking ring by pivots having a slight construction clearance.

3. The reversible mechanical coupling according to claim 1 wherein said wedges have a convergence angle lower than the minimum friction angle.

4. The reversible mechanical coupling according to claim 1 wherein said plurality of clamping levers further comprise three pairs of clamping levers disposed around said cylindrical body at 120° relative to each other.

5. The reversible mechanical coupling according to claim 1 wherein said plurality of wedges further comprise three wedges disposed around said cylindrical body at 120° relative to each other.

6. The reversible mechanical coupling according to claim 1, further comprising a flow partitioner for identically feeding each oleodynamic cylinder of said first and second oleodynamic cylinder means with hydraulic fluid, said flow partitioner being disposed within said cylindrical body in an oil bath.

7. The reversible mechanical coupling according to claim 6 wherein said flow partitioner further includes on oleodynamic motor corresponding to each oleodynamic cylinder of said first and second oleodynamic cylinder means.

8. The reversible mechanical coupling according to claim 1 further comprising a first set of hooks mounted on said cylindrical body above said upper linking ring configured and dimensioned to engage and hold said upper linking ring when said upper linking ring is urged upwardly away from said vertical wedges and a second set of hooks mounted on said cylindrical body above said lower linking ring configured and dimensioned to engage and hold said lower linking ring when said lower linking ring is urged upwardly away from said conical section of said cylindrical body.

9. The reversible mechanical coupling according to claim 8 further comprising:

(a) lifting eyes mounted on said upper linking ring, whereby upward lifting force applied to said lifting eyes urges said upper linking ring upward to engage said upper linking ring with said first set of hooks, thereby disengaging said plurality of wedges from said cylindrical portion of said anchorage seat, and (b) an anchorage lower end seat below said conical seating surface, said anchorage lower end seat engaging said clamping levers when said cylindrical body is urged downwardly after said wedges have been disengaged from said anchorage seat so as to engage said lower linking ring with said second set of hooks, whereupon said clamping levers are no longer forced outwardly by said conical section and said cylindrical body may be removed from said anchorage seating by applying upward lifting force.

10. The reversible mechanical coupling according to claim 1 further comprising spring means urging said clamping levers toward said cylindrical body.

* * * * *